United States Patent [19]

Geringer et al.

[11] Patent Number: 4,596,411

[45] Date of Patent: Jun. 24, 1986

[54] DOOR LOCKING AND MONITORING ASSEMBLY

[76] Inventors: Arthur V. Geringer, 5424 Geyser, Tarzana, Calif. 91356; Richard G. Geringer, 28834 Barragan St.; David A. Geringer, 5382 Cheseboro Rd., both of Agoura, Calif. 90301

[21] Appl. No.: 528,873

[22] Filed: Sep. 1, 1983

[51] Int. Cl.[4] ..... E05C 1/16

[52] U.S. Cl. ..... 292/165

[58] Field of Search ..... 292/144, 165, 201, 153, 292/254, 333, 335

[56] References Cited

U.S. PATENT DOCUMENTS

| | | | |
|---|---|---|---|
| 1,473,378 | 11/1923 | Moore | 292/165 X |
| 1,706,486 | 3/1929 | Gasey | 292/165 X |
| 2,838,925 | 6/1958 | Backhouse | 292/153 X |
| 3,316,001 | 4/1967 | Russell et al. | 292/153 |
| 4,271,691 | 6/1981 | Logan | 292/254 X |
| 4,529,234 | 7/1985 | Senften | 292/150 X |

*Primary Examiner*—Richard E. Moore

*Attorney, Agent, or Firm*—John J. Posta, Jr.

[57] ABSTRACT

An improved door locking and monitoring assembly is provided which is power activated. The assembly comprises a lock assembly in a housing, which housing is disposed in a door. The lock assembly has a latch trip member extending therefrom along with an ordinary latch. An actuating and switching assembly is disposed in a housing located in the door frame, including a power activated bolt located opposite from and adapted to displace the trip member, and a switch located opposite the latch and adapted to signal the relative position of the latch. The lock assembly has a series of interacting, pivoted arms which co-act in a manner to prevent rotation of the door-knob hub while locking the latch in an extended position, all upon actuation of the bolt to displace the trip member into the lock assembly. Signalling means are employed to indicate the state of the lock assembly.

3 Claims, 3 Drawing Figures

DOOR LOCKING AND MONITORING ASSEMBLY

BACKGROUND OF THE INVENTION

1. Field of The Invention

The present invention generally relates to door locks and more particularly to an improved power activated door locking and monitoring assembly.

2. Prior Art

Various types of power activated door locking mechanisms are currently available. Many of these mechanisms are very bulky, complicated and expensive and few offer much versatility. In the event door locking mechanisms are overcome, there is no simple remote monitoring mechanism provided to determine whether the door is in fact opened, closed, locked, lockset, etc. Furthermore, no simple mechanism has been heretofore provided which allows a door to be opened and closed at will, unless and until a remotely activated mechanism in the door frame interacts with a plurality of simplified components in the door to simultaneously prevent the door handle from being rotated and prevent the latch from being retracted to open the door.

Accordingly, there is a need for a simple, durable, compact, inexpensive and efficient power door locking system of an improved type which includes remote means for automatically locking the door and hub of the door-knob while automatically monitoring the status of the door and door lock assembly.

SUMMARY OF THE INVENTION

The improved door locking and monitoring assembly of the present invention satisfies all the foregoing needs. The assembly is substantially as set forth in the Abstract above. Thus, the assembly is compact and comprises a housing which fits inside a door and an assembly located with the door frame opposite the housing which co-acts therewith.

The lock housing carries a door-knob hub secured to a rotatable camming member having a concave portion along its periphery and a slot on the opposed side. A first, spring biased, pivoted arm carries a convex cam member which co-acts with the concave portion of the rotatable camming member to return the door-knob to a normal position after rotation therefrom.

A latch member extends from the housing and has a journalled rod extending from the rear end thereof, which rod carries a projection on the opposite end thereof. A second spring biased, pivoted arm cooperates with said first arm and projection to move said latch to and fro, overcoming a spring disposed about said rod which normally biases the latch outwardly from the door.

A trip member is provided above the latch, which normally extends outward from the door through an opening in the housing, the trip member abuts a third spring biased, pivoted arm, which bias tends to maintain said trip member extended outwards. The lower end of the third arm carries a post thereon.

A fourth spring biased, pivoted arm is provided having an opening therein which receives the post extending from the third arm. This opening is designed so that a certain predetermined camming action takes place between the post and the periphery of the opening in a manner set forth below.

A fifth arm is pivoted at one end and is rotatably connected to the third arm at the other end. A slideable locking plate is provided which moves back and forth, into and out of the slot in the rotatable camming member on the hub, to lock the hub in a fixed position in response to movement of the fifth arm, which is slideably connected thereto.

The fourth arm has an extension thereon which moves in and out of an obstructing position to movement of the latch.

A powered bolt is provided in the door frame opposite the trip member which, upon actuation, moves the trip member out of the recess in the door frame and into the housing of the lock. Such movement causes the trip member to rotate the third arm which in turn rotates the fifth arm causing the locking plate to move into the slot in the camming member, thereby preventing rotation of the door knob. Rotation of the third arm simultaneously moves the post to a position allowing rotation of the fourth arm whose projection moves to obstruct movement of the latch, thereby locking said latch in an extended position into a recess in the door frame.

Appropriate signalling devices are provided to monitor the position of the trip member and the latch to monitor the locking assembly.

DETAILED DESCRIPTION OF THE PREFERRED EMBODIMENT

Figure 1:
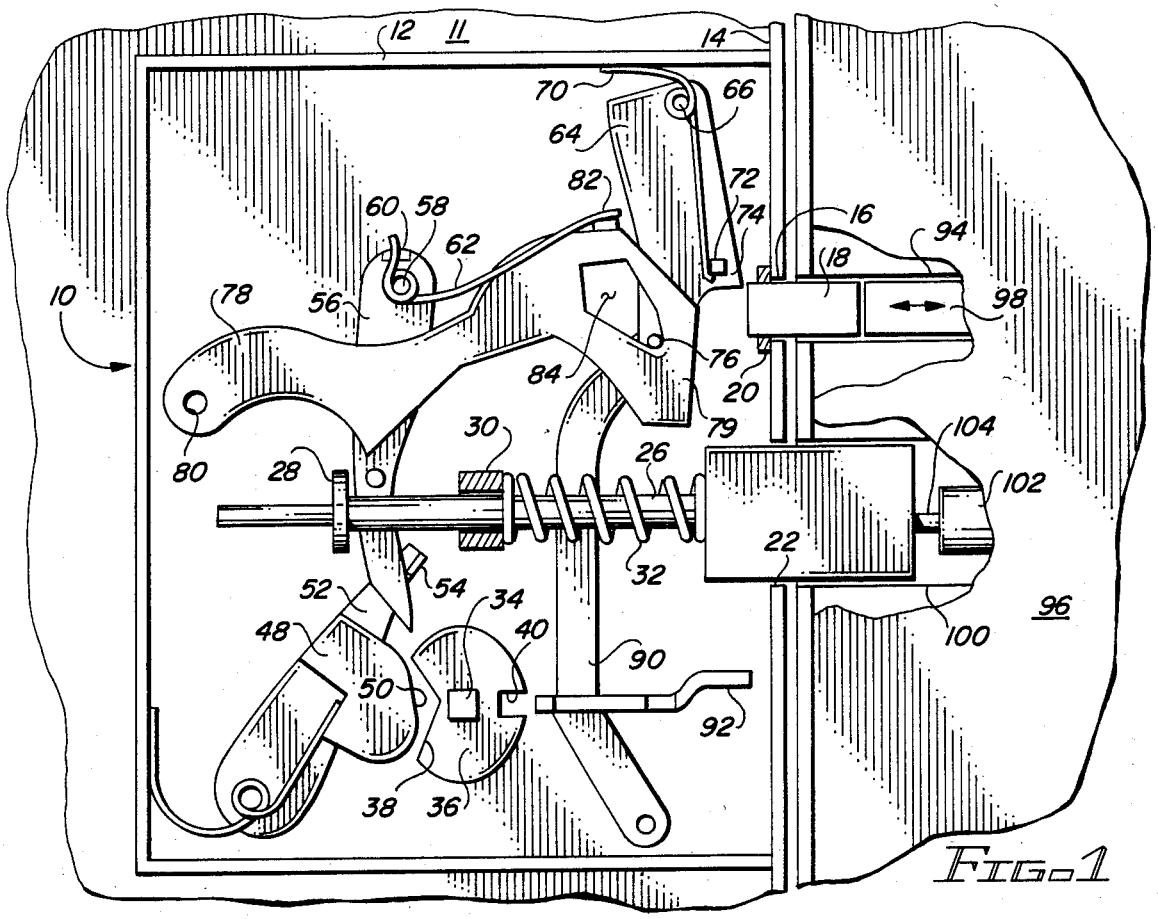
FIG. 1 is a schematic side elevation of a preferred embodiment of the door locking and monitoring assembly in an unlocked state showing the lock assembly mounted in a door and the actuating and monitoring assembly mounted opposite it in the door frame.

Now referring more particularly to FIG. 1, a door lock assembly 10 has a housing 12 is mounted in door 11. Face plate 14 having an upper opening 16 therein adapted to moveably retain trip member 18 therein. Trip member 18 has several projections 20 which prevent trip member 18 from passing through opening 16.

A second opening 22 is provided in face plate 14 adapted to receive latch 24 extending therethrough. Latch 24 has a rod 26 extending rearwardly, such rod having a projection 28 on the reverse end thereof. Guides 30 allow reciprocation of rod 26 therein. Spring 32 is disposed between the rear of latch 24 and guides 30 to bias the latch through opening 22.

Hub 34 of a door knob (not shown) carries cam member 36 which has a cavity 38 on one side and a slot 40 in the reverse side thereof. A first arm 42 is rotatable about pivot member 44 and biased in a clockwise direction by spring 46. Arm 42 has a raised portion 48 against which the end of spring 46 abuts, along with a concave face 50 which extends into and co-acts with cavity 38. Cavity 38 and face 50 are so designed that rotation of hub 34 in either direction will cause counterclockwise rotation of arm 42. Release of rotational force on hub 34 to its original position. Arm 42 has an extension 52 which carries a post 54.

A second arm 56 is pivoted at 58 in housing 12 and carries a post 60 having one end of spring 62 inserted in a hole therein. Arm 56 extends downward under rod 26 and above extension 54, while contacting post 54 on one side thereof.

A third arm 64 is provided which is pivoted at 66 in housing 12 while being biased by spring 68 having one end 70 restrained by housing 12 and the other end by projection 72 extending from arm 64. Lower portion 74 of arm 64 lies in the path of travel of trip member 18 and normally abuts trip member 18. Post 76 is carried by and extends from arm 64.

A fourth arm 78 is pivoted about pivot 80 and is biased by spring 62 acting on projection 82. An opening 84 in the far end of arm 78 and receives therein post 76. The surface defining opening 84 presents a cammed surface which interacts with post 76 to rotate arm 78 and lower end 79.

A fifth arm 86 is provided which is pivoted at 88 to housing 12 and is rotatably connected to the underside of arm 64.

A locking plate 92 has extensions passing through slots in housing 12 allowing reciprocating movement thereof. Plate 92 has an opening therein allowing passage therethrough of arm 90. Rotation of arm 90 causes reciprocation of plate 92 into and out of slot 40.

A recess 94 is provided in door frame 96 into which trip member 18 projects. Actuating bolt 98 reciprocates in recess 94 and serves to move trip member out of recess 94 and backwards into lock assembly 10. Bolt 98 can be actuated manually or by a remotely actuated, electric power generation means such as a solenoid and associated actuating members, all of which are well known in the art.

A second recess 100 is provided in door frame 96 which receives latch 24. A switch 102 with actuator 104 is provided, with associated circuitry to signal the relative position of latch 24. A standard latch plate 106 is also secured to door frame 96.

The actuated bolt 98 and switch 102 can be, for example, of the type of novel assembly shown in applicant's copending patent application entitled "Improved Power Actuated Door Locking and Monitoring Assembly, " Ser. No. 528,874 filed Sept. 1, 1983.

In operation, the open door 11, having trip member 18 and latch 24 extending therefrom, is moved to a closed position, first contacting latch plate 106. The longer of the two, latch 24, is cammed inwardly to prevent lower end 79 of arm 78 from dropping down behind it. Trip member 18 is then cammed inwardly by latch plate 106 allowing arm 78 to move downward to obstruct latch 24, but this does not happen because latch 24 has already moved to the left. Upon being aligned with recesses 94 and 100, trip member 18 and latch 24 fall, respectively into such recesses, to retain the door in a locked position.

Figure 3:
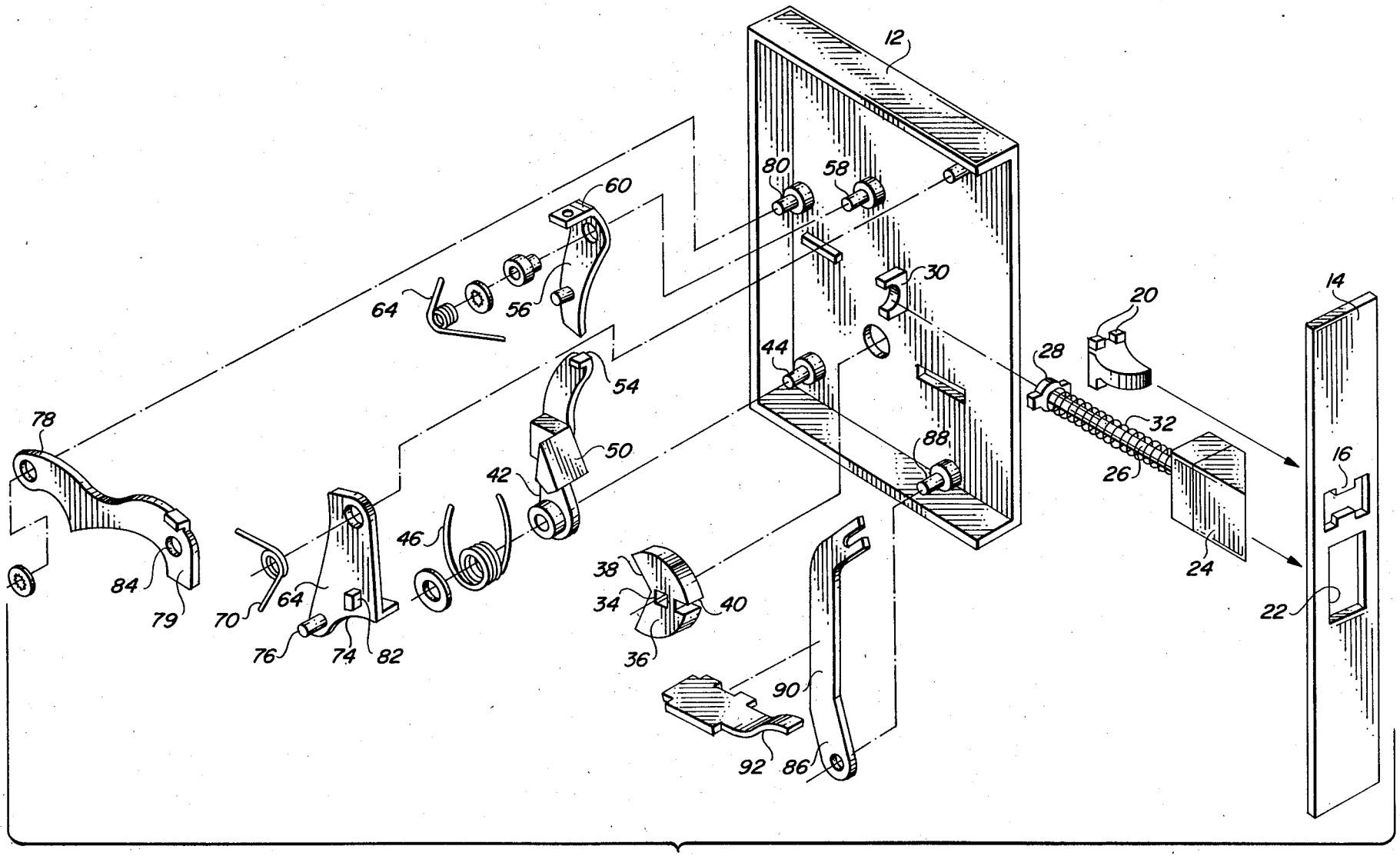
FIG. 3 is an exploded view of the lock assembly components.

If one desired to open the door 11, hub 34 is rotated, causing camming member 36 to cam arm 42 counterclockwise, thereby causing post 54 to move arm 56 clockwise, which arm 56, since it abuts projection 28 on rod 26, retracts rod 26 and latch 24, enabling opening of door 12. It should be noted that, as shown in FIG. 3, latch 24 has a flat upper side and an angled reverse side, while trip member 18 is angled on both sides, thereby allowing the trip member 18 to be cammed into or out of recess 94, as opposed to latch 24 which can be cammed open only when its angled side is presented.

Figure 2:
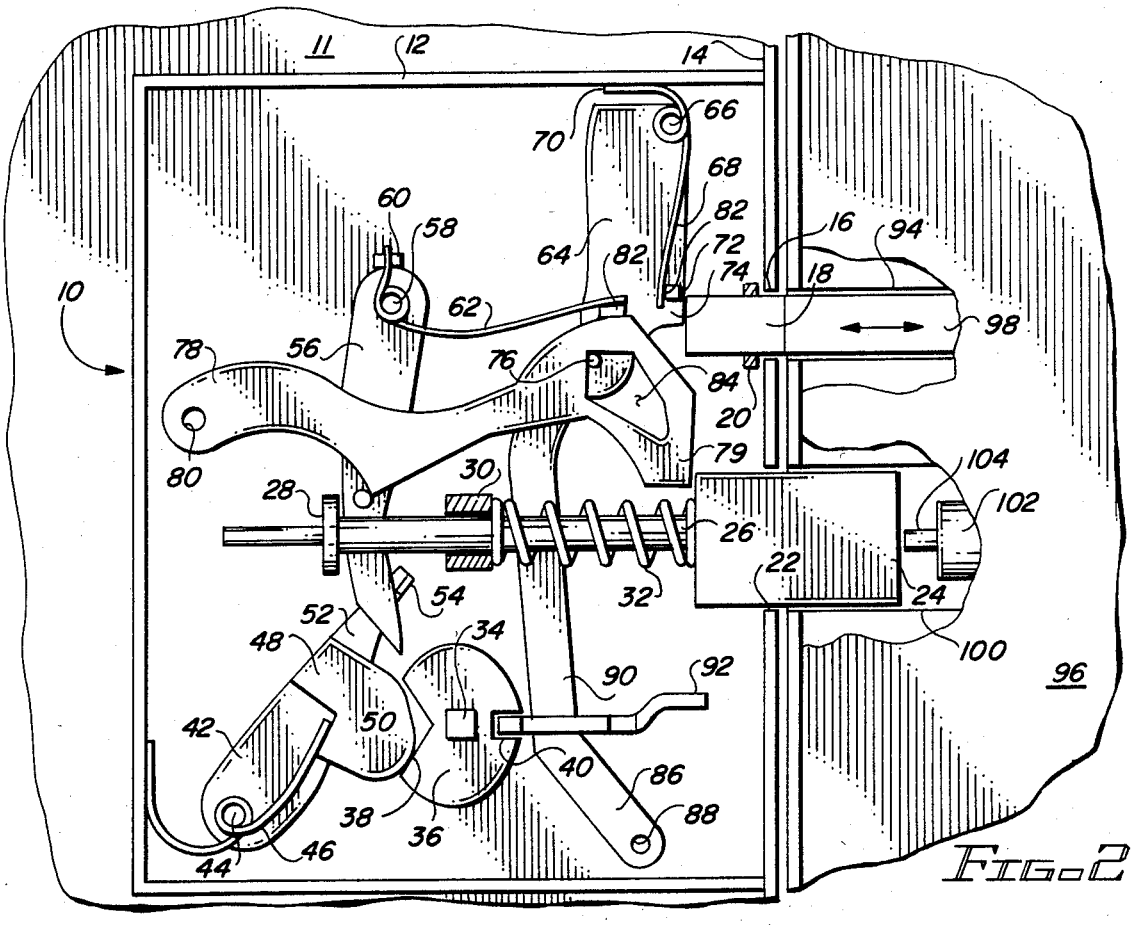
FIG. 2 is a schematic side elevation of the assembly of FIG. 1 in a locked state.

To lock the door 11 and prevent rotation of hub 34, bolt 98 is actuated to force trip member 18 inwardly, causing clockwise rotation of arm 64. This moves post 76 inward allowing clockwise rotation of spring biased arm 78, thereby moving lower end 79 thereof into the path of latch 24, preventing movement of latch from recess 100 and locking the door. Simultaneously, rotation of arm 64 causes counterclockwise rotation of arm 86 rotatably connected thereto, in turn causing locking plate 92 to slide into recess 40, thereby locking hub 34 and preventing rotation thereof. So long as power is maintained to bolt 98, the hub 34 and latch 24 will be locked in position. FIG. 2 shows the respective locations of the lock assembly components when in a locked position.

The signalling mechanism can be similar to that provided for and described in the above identified patent application, with a signal being given when either one or both of sensory switches located near the recesses in the door frame are closed and/or open.

It is apparent that applicant has provided a novel door lock assembly enabling simultaneous locking of a door knob as well as the latching member. It is apparent that modifications, alterations, additions and substitution of equivalent components can be included in the assembly without departing from the spirit and scope of the invention disclosed, it being the intention of the inventor to be limited only by the scope of the appended claims.

What is claimed is:

1. An improved door locking assembly, comprising:

(a) a door frame;

(b) a lock assembly housing adapted to be carried by a door;

(c) a door knob hub disposed in said housing;

(d) a latch member disposed in said housing;

(e) door knob hub locking means disposed in said housing and including a moveable hub locking member adapted to connect to and lock in place said door knob hub;

(f) hub locking member positioning means connected to said locking means;

(g) said positioning means including a trip member;

(h) actuating means for displacing said trip member;

(i) whereby movement of said trip member actuates said door hub locking means to freeze said hub in a predetermined position;

(j) stop means for preventing movement of said latch member to a fully retracted position;

(k) wherein said trip member is connected to said stop means and wherein movement of said trip member causes said stop means to prevent movement of the latch member to a fully retracted position;

(l) said positioning means further including a first arm pivotally connected to said housing and having a portion thereof abutting said trip member;

(m) said positioning means also including a second arm pivotally connected to said housing and having an intermediate portion thereof abutting said door knob hub locking means and the end portion thereof connected to said first arm.

2. The assembly of claim 1 wherein positioning of the latch to a retracted state when the trip member is moved prevents locking of the latch.

3. The assembly of claim 1 including indicator means to indicate the state of said locking assembly.

* * * * *